US005295764A

United States Patent [19]

Cunat

[11] Patent Number: 5,295,764

[45] Date of Patent: Mar. 22, 1994

[54] TUNNEL LINER

[75] Inventor: Richard J. Cunat, Boardman, Ohio

[73] Assignee: WCI Steel, Inc., Warren, Ohio

[21] Appl. No.: 744,949

[22] Filed: Aug. 14, 1991

[51] Int. Cl.[5] ..... E21D 5/08

[52] U.S. Cl. ..... 405/151; 405/150.1; 52/86; 52/821

[58] Field of Search ..... 405/146, 150.1, 151, 405/152, 153; 52/86, 89, 630, 821, 827, 828

[56] References Cited

U.S. PATENT DOCUMENTS

| | | | |
|---|---|---|---|
| 1,778,606 | 10/1930 | Proctor | 405/150.1 |
| 1,967,489 | 7/1934 | White . | |
| 2,114,834 | 4/1938 | Foukal | 405/153 |
| 3,334,007 | 8/1967 | Flagan | 52/828 X |
| 3,357,194 | 12/1967 | Fisher | 405/153 |
| 3,488,965 | 1/1970 | Chesnov | 405/151 |
| 3,976,269 | 8/1976 | Gupta | 52/828 X |
| 4,070,866 | 1/1978 | Juvrud | 405/153 X |
| 4,194,330 | 3/1980 | Smith | 52/828 X |
| 4,802,321 | 2/1989 | Menchetti | 52/827 X |

OTHER PUBLICATIONS

Soft Ground Tunneling, Aug., 1981 Commercial Shearing Inc.

*Primary Examiner*—Randolph A. Reese
*Assistant Examiner*—John Ricci
*Attorney, Agent, or Firm*—Oldham, Oldham & Wilson Co.

[57] ABSTRACT

Tunnel liner plate assembly comprising a tunnel liner plate comprising an outer wall and inwardly extending side and end flanges, each having bolt holes therein, and a longitudinally extending plate metal reinforcement extending from end flange to the other and comprising a center section which abuts the outer wall of the liner plate, a pair of upstanding side section which are integrally joined to the center section along respective side edges, and laterally projecting flanges which project laterally from the upper (or inward) edges of the respective side sections. The center section and the side sections together provide a U-shaped configuration and the laterally projecting flanges, which are spaced from the outer plate of the outer wall of the tunnel liner plate and are parallel thereto, afford a marked increase in moment of inertia and section modulus with very little increase in mass. An assembly, or reinforced liner plate, according to this invention has a much greater moment of inertia and much greater section modulus than does an unreinforced liner plate of the same thickness. Correspondingly, the strength of a reinforced tunnel liner plate of this invention is appreciably greater than the strength of an unreinforced tunnel liner plate of the same thickness. Also, the weight of a tunnel liner plate assembly of this invention appreciably less than that of an equivalent unreinforced tunnel plate having the same strength.

9 Claims, 5 Drawing Sheets

TUNNEL LINER

TECHNICAL FIELD

This invention relates to tunnel liners and more particularly to a novel tunnel liner plate assembly comprising a tunnel liner plate and a novel reinforcement which substantially increases the strength of the tunnel liner plate without corresponding increase in weight.

BACKGROUND ART

In constructing tunnels, arches or the like, a suitable opening is excavated. As excavation proceeds, it is usually necessary to provide support in order to prevent cave-ins and carry the weight bearing on the tunnel. Wooden beams were formerly used for support; however, in more recent years, the preferred structures are tunnel liners made from metal and preferably steel plates. A tunnel liner plate is typically a four-sides structure, having a generally rectangular configuration, having two longitudinally extending sides and two transversely extending ends, and is curved in the longitudinal direction to conform to the curvature of the tunnel being lined. As tunneling progresses, it is common practice to install the liners ring by ring just behind the forward end of the tunnel. A ring of tunnel liner plates is an assemblage of plates joined together end to end and extending around the circumference of the tunnel. Successive rings or courses of tunnel liner plates are typically arranged in off-set fashion similar to successive courses in a brick wall.

The most common cross-sectional shape of a tunnel is circular (or approximately circular), and so tunnel liner plates commonly have an arcuate or circular curvature in the longitudinal direction and typically no curvature in the transverse direction. However, other cross-sectional shapes of tunnels, as for example, are typically more than 180 degrees but less than 360 degrees, ("arcuate" denoting any part of a true circle), semi-circular, and horse-shoe shape.

A tunnel liner plate may have inwardly extending flanges along both its sides and ends, or along its sides only, said flanges typically having bolt holes so that adjacent liner plates can be bolted together to form a tunnel liner.

U.S. Pat. No. 1,967,489 to White shows a representative tunnel liner. The tunnel liner plate illustrated therein is constructed of plate metal, provided with inwardly extending flanges along both its side edges and its end edges, with bolt holes in all flanges. The main portion or body wall of the plate is provided with a pair of spaced longitudinally extending ribs for reinforcement. These ribs stand out from the outer face of the body wall and comprise transversely flat (and longitudinally curved) facing walls.

The neutral axis of the liner plate in U.S. Pat. No. 1,967,489 is illustrated in FIG. 3 thereof. Every tunnel liner plate has a neutral axis, which extends from side to side as shown in FIG. 3 of the White patent. The center of mass of the liner plate is located along the neutral axis.

U.S. Pat. No. 2,114,834 to Foukal shows a tunnel liner plate having side and end flanges with bolt holes therein, and provided with a thrust member in the form of a corrugated plate that is curved to conform to the curvature of the liner plate 4, and which has corrugations extending from side to side of the liner plate. The corrugated plate may be secured to the liner plate by welding the lateral edges of the former to the side flanges of the latter. Foukal also illustrates the formation of a ring of liner plates, by bolting adjacent plates together along their respective end flanges.

U.S. Pat. No. 3,357,194 to Fisher shows a tunnel liner plate which, in transverse cross-section, comprises a relatively flat central portion, corrugations on either side thereof, and side edge flanges which are disposed essentially parallel to the central portion of the liner plate, rather than at right angles thereto. One of these flanges, "the leading edge flange" (this term being used with reference to the tunneling direction) is disposed outside the neutral axis and the other, the "trailing edge flange", is disposed inside the neutral axis as shown in FIG. 2. Additional supporting members in the form of removable channels, I-beams (the form shown in the drawing) or H-beams may be provided. Patentee states that his tunnel liner plate, by virtue of his flange structure, is capable of being stored more compactly and is easier to install than a tunnel liner plate having either two or four inwardly extending flanges provided with bolt holes. Patentee also states that his tunnel liner plate requires less weight of material in relation to strength.

Most tunnel liner plates continue to have either two or four inwardly extending flanges which are disposed along the edges of the liner plate (or more specifically the outer wall thereof), as shown for example in U.S. Pat. No. 1,967,489 to White, cited supra.

Meanwhile, the art continues to look for a liner plate having a more favorable strength to weight ratio than that afforded by a conventional flanged liner plate such as that shown in the White patent.

DISCLOSURE OF THE INVENTION

It is an object of this invention to provide a novel liner plate assembly having greater strength, moment of inertia and section modulus than those of a conventional flanged liner plate of equal thickness and weight It is a further object of this invention to provide a liner plate assembly having a permanently positioned reinforcement (or reinforcing member) which materially increases the strength, moment of inertia and section modulus of a liner plate without a corresponding increase in weight, so that the assembly has a more favorable strength to weight ratio than that of a liner plate of equal thickness by itself.

These and other objects are achieved, according to this invention, in a tunnel liner plate assembly which comprises:

a) a tunnel liner plate comprising a longitudinally curved outer wall, inwardly extending side flanges and inwardly extending end flanges, each of said flanges having a plurality of bolt holes; and b) a stiff longitudinally extending reinforcement comprising a longitudinally curved center portion which abuts the outer wall of said liner plate, a pair of upstanding longitudinally extending side portions which are integrally joined to said center portion along longitudinally extending edges, and laterally projecting members which are integral with respective side portions and disposed laterally outwardly therefrom and which are spaced from said outer wall of said liner plate, said reinforcements having end edges which abut the respective end flanges of said liner plate and are attached thereto, the configuration of the center portion and the upstanding side portions of said reinforcement being such as not to interfere with any of the bolt holes of the end flanges.

BRIEF DESCRIPTION OF THE DRAWINGS

Figure 1:
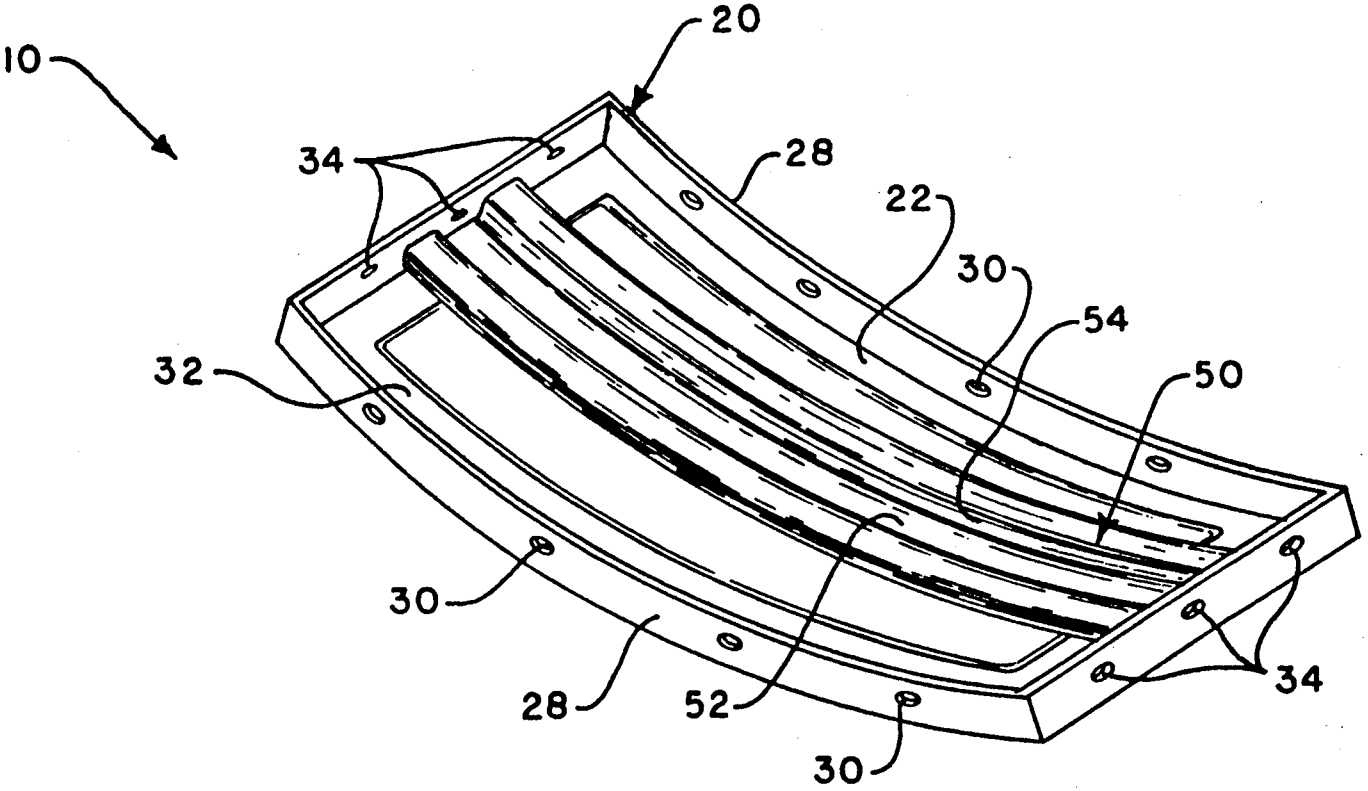
Figure 2:
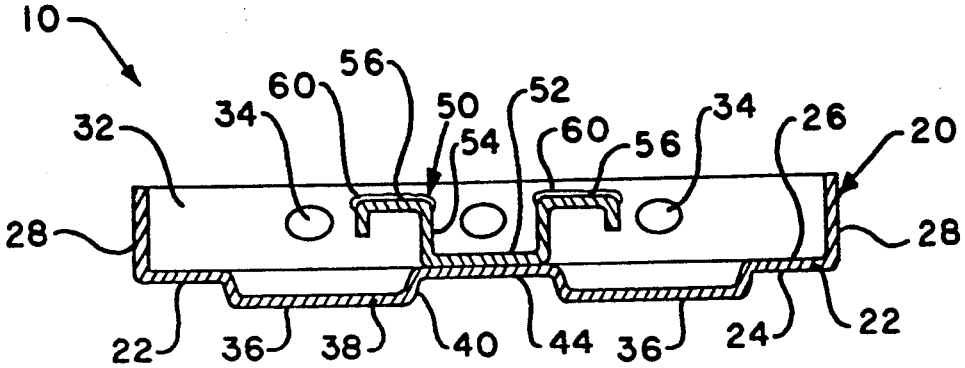
Figure 3:
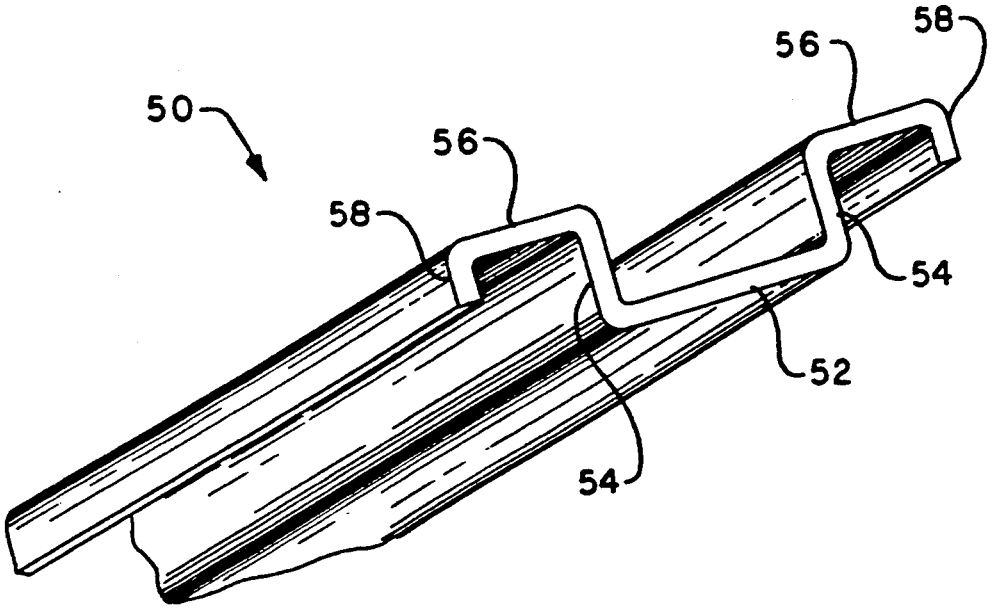
Figure 4:
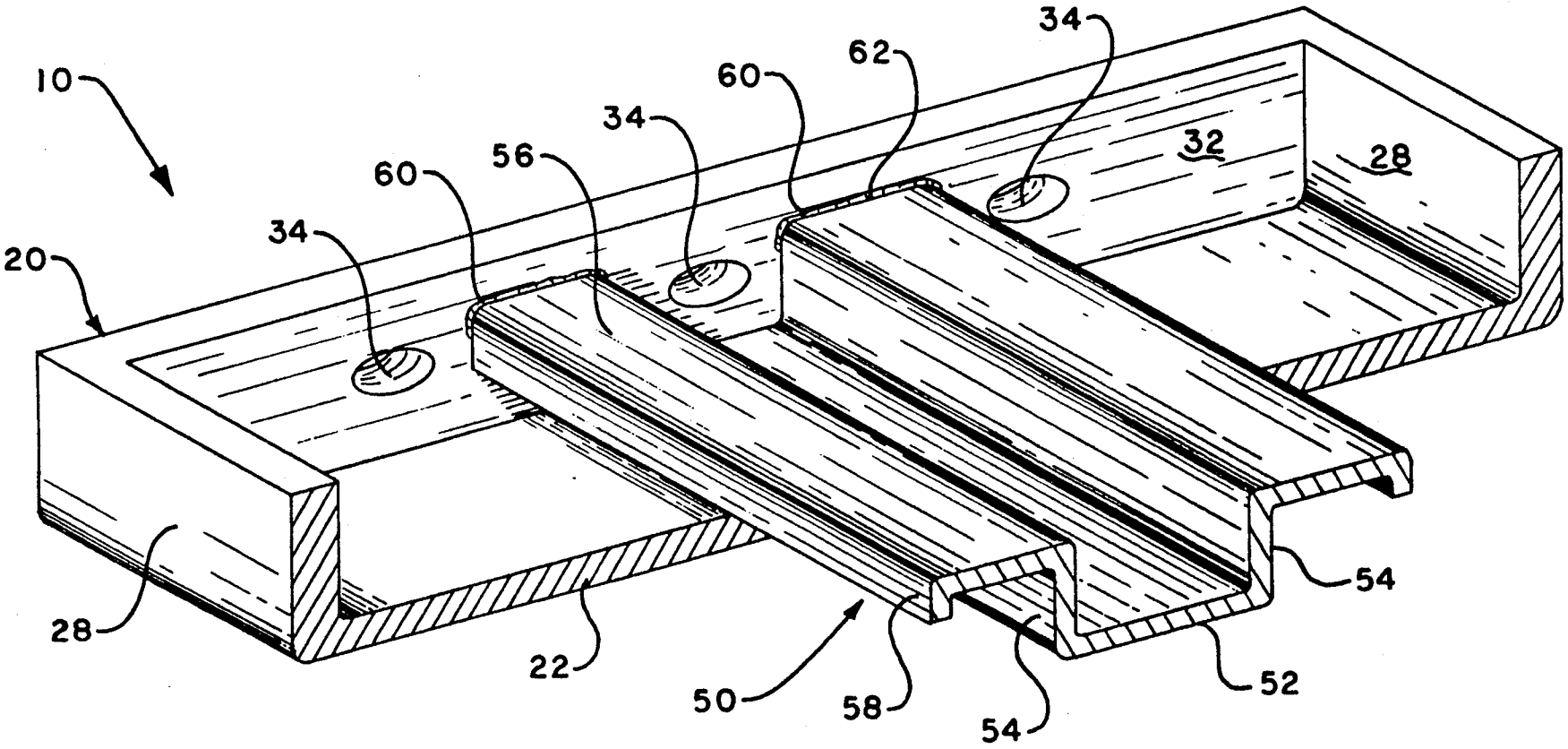
Figure 5:
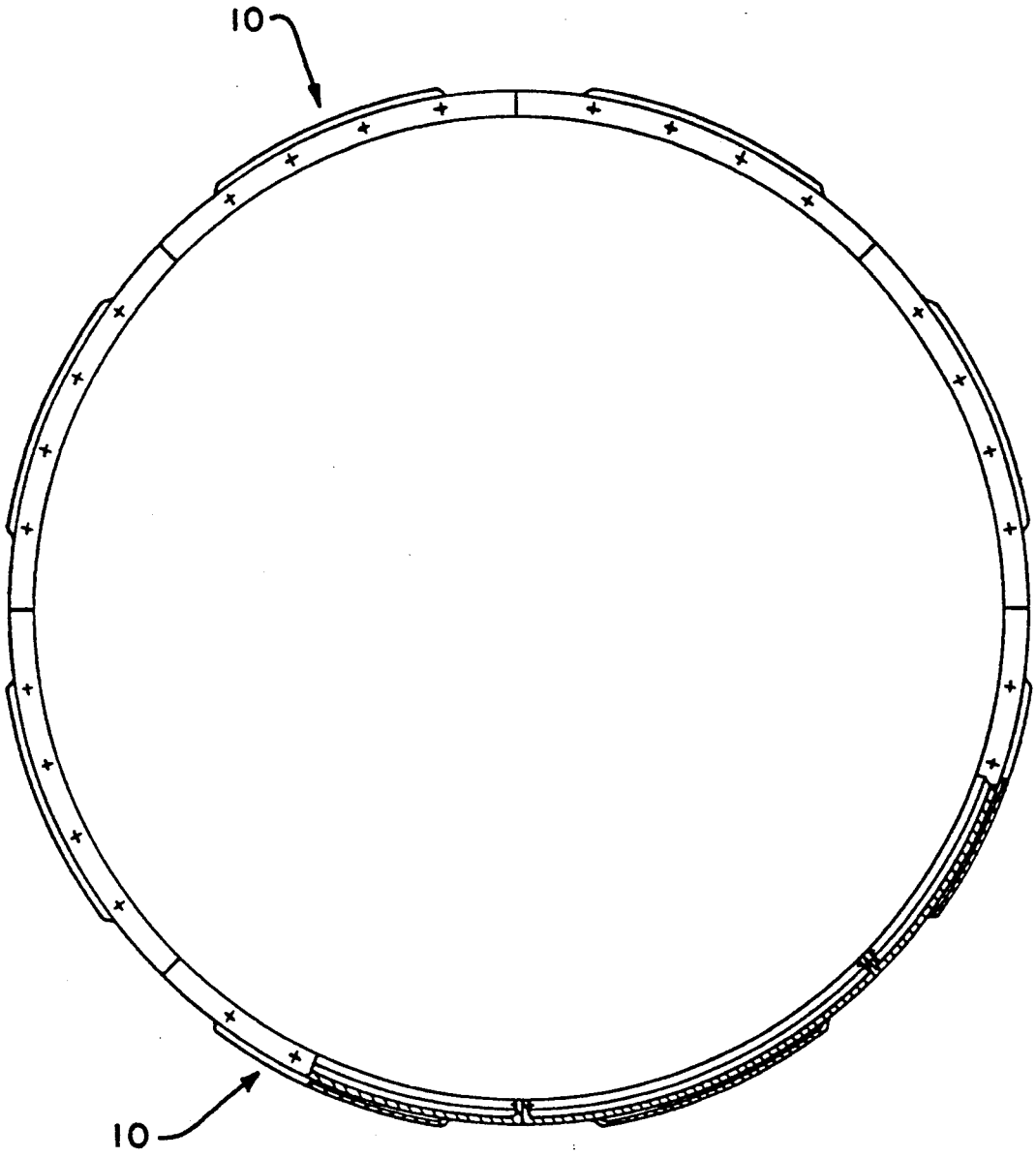
Figure 6:
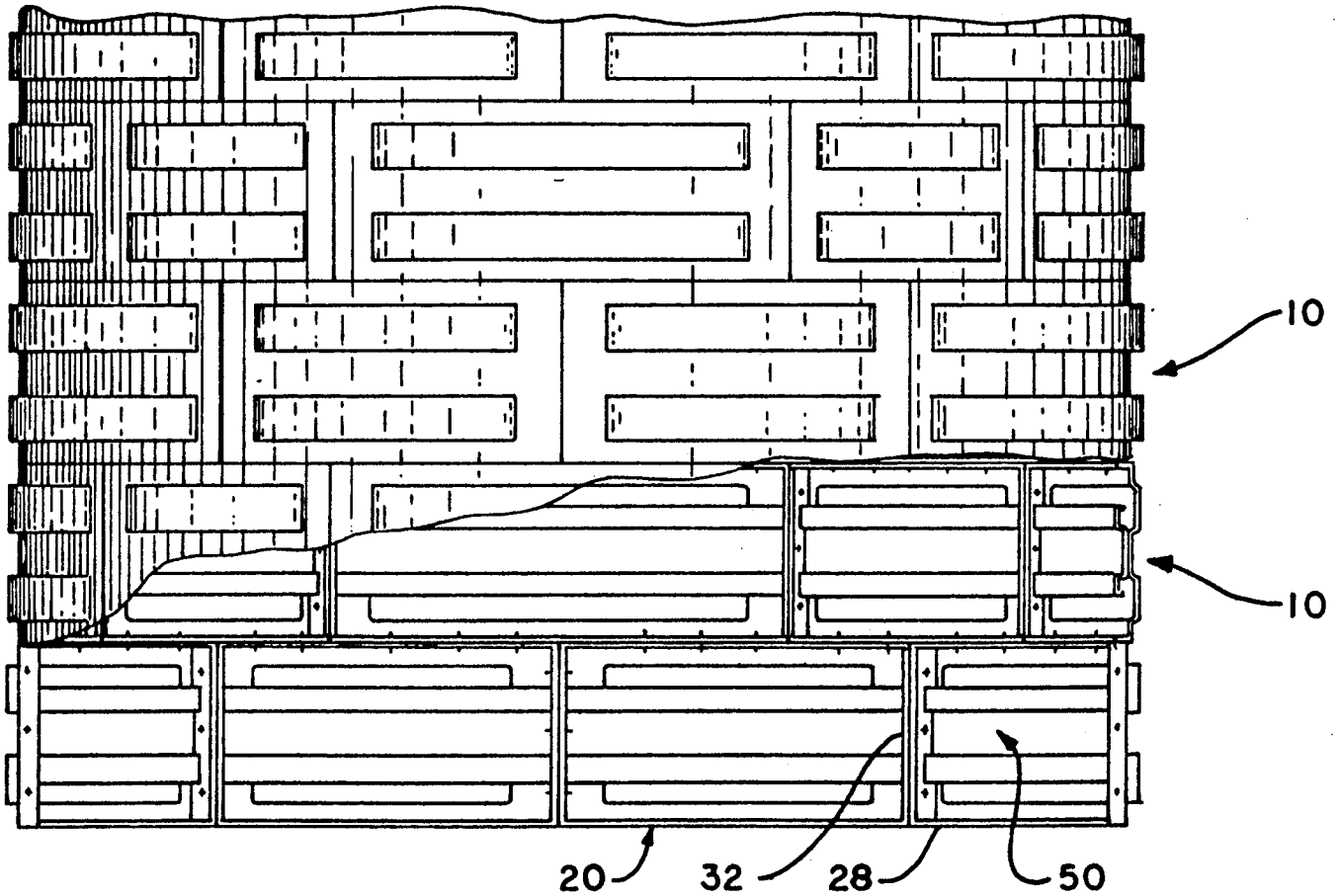

IN THE DRAWINGS:

FIG. 1 is a perspective view of a liner plate assembly according to this invention;

FIG. 2 is a vertical sectional view of a liner plate assembly of this invention, taken along line 2—2 of FIG. 1;

FIG. 3 is a fragmentary perspective view of a reinforcement according to the present invention, shown "straight" as formed rather than longitudinally curved;

FIG. 4 is a view taken along line 4—4 of FIG. 2, showing one end of a liner plate assembly according to this invention, including a liner plate end flange and one end of the reinforcement, and showing the welding of the end of the reinforcement to the liner plate end flange;

FIG. 5 is a front elevational view, with parts broken away and shown in section, of a ring of liner plate assemblies of this invention;

FIG. 6 is a fragmentary elevational view of a tunnel liner installation, as seen from the interior of a tunnel, showing a plurality of courses of liner plates and showing (in a portion of the Figure) liner plate assemblies of this invention in plan view.

DESCRIPTION OF THE PREFERRED EMBODIMENT

This invention will now be described in further detail with reference to the best mode and preferred embodiment thereof.

FIGS. 1 and 2 of the drawing show a liner plate assembly 10 according to this invention. Liner plate assembly 10 comprises a liner plate 20 and a reinforcement to be hereinafter described. Liner plate 20 is a longitudinally curved structure of generally rectangular configuration. It is made of plate metal, typically steel. Liner plate 20 comprises an outer wall 22 which has an outside surface 24 and an inside surface 26. This outer wall constitutes the main portion of the tunnel liner plate. The outer wall 22 is bounded by two spaced parallel side (or longitudinal) edges, which are arcuate, and two spaced parallel end (or transverse) edges, which are straight. Side flanges 28 extend inwardly from the side edges. Each of the side flanges 28 has a plurality of uniformly spaced bolt holes 30 (4 are shown, and this number is used in commercial practice). Flanges 28 extend from one end of the tunnel liner plate to the other. Tunnel liner plate 20 also has a pair of end flanges 32, which extend inwardly from the end edges of the outer wall 22 and which extend from one side of the tunnel liner plate to the other. The side flanges 28 and the end flanges 32 are of the same height (or depth) and together extend around the entire perimeter of tunnel liner plate 20. Each of the end flanges 32 has a plurality of uniformly spaced bolt holes 34. There are typically an odd number of bolt holes on each end flange, so that one of the bolt holes is located along the longitudinal axis of the tunnel liner plate 20. Three bolt holes are shown, and this is representative of commercial practice.

The outer wall 22 of tunnel liner plate 20 may have a pair of spaced parallel longitudinally extending reinforcing ribs 36. These ribs 36 extend outwardly from the outer wall 22. Each of the ribs 36 comprises a central portion 38 of plate metal, which is longitudinally curved and parallel to outer wall 22 but disposed outwardly therefrom, and side walls (typically sloping) which connect the central portions 38 of the ribs to the outer wall 22 of the liner plate. The ribs may be of any desired shape, e. g. rectangular as shown. These reinforcing ribs 36 add reinforcement to the liner plate, as explained in U.S. Pat. No. 1,967,489 to White cited earlier. Between the two ribs 36 is a longitudinally extending center web 44, which is a portion of the outer plate 22. The outer wall 22 may be a smooth plate, i.e., without ribs 36, if desired.

The structure of the liner plate 20 may be conventional. The liner plate 20 herein illustrated is generally similar to that shown in U.S. Pat. 1,967,489 to White cited earlier. The liner plate may be made to standard dimensions and of standard thicknesses of steel. The radii of curvature may also be standard. As is apparent from the earlier description, the plate is curved only in the longitudinal direction; it is essentially uncurved in the transverse direction. The plate may be of standard width, e. g. 16 inches (about 40.6 cm), of standard flange depth of about 2 inches (about 5.1 cm), and the length may be either 37 11/16 inch (about 95.7 cm) for a full plate or 18 27/32 inch (about 47.9 cm) for a half plate. The thickness of the liner plate 20 may range from about 0.1 inch (0.25 cm) to about 0.4 inch (1.0 cm) and more particularly from 12 gauge (0.1046 inch or 0.2657 cm) to ⅜ inch (0.375 inch or about 0.95 cm).

The radius of curvature of liner plate 20 corresponds to the radius of curvature of the tunnel being lined. Ordinarily it is not necessary to line tunnels less than 4 feet in diameter (2 foot radius). Therefore, for practical purposes, the minimum radius of curvature of liner plate 20 will be about 2 feet.

As installed in a tunnel, the longitudinal direction of the plate is the circumferential direction of the tunnel, and the transverse or lateral direction of the plate is the axial direction of the tunnel.

Certain terms herein are used in accordance with conventions in the tunnel liner art. Thus, the outside surface 24 of outer wall 22 denotes the surface which faces a tunnel wall and the inside surface 26 denotes the surface which faces toward the interior of the tunnel and the center of curvature of the plate. (The center of curvature of the plate typically coincides with the axis of the tunnel). The flanges 28 and 32 are characterized as extending inwardly, i. e. toward the center of curvature.

Liner plate assembly 10 also includes a reinforcement 50. Reinforcement 50 is a longitudinally extending member, of uniform cross-section over its entire length, which is formed separately from the liner plate but then installed therein and secured, (e. g. by welding) thereto. The reinforcement 50 extends from one end flange 32 of the liner plate 22 to the other end flange 32, and is curved (and usually arcuate) to match the curvature of the liner plate. Reinforcement 50 comprises a longitudinally extending arcuate center portion 52 and a pair of upstanding longitudinally extending side walls or side portions 54 which are integrally joined to the center portion 52 along the side edges thereof. The center portion 52 and the side portions 54 together form a channel of generally U-shaped cross-section. The center portion 52 is in abutting relationship with the center web 44 of the outer wall 22 of liner plate 20. The side portions 54 extend inwardly from the outer wall 22 to a depth (or height) which is less than the depth of the flanges 28 and 32.

The depth (or height) of the reinforcement 50 is less than that of flanges 28 and 32 so that the reinforcement will not reduce the effective diameter of the tunnel.

In order to increase the moment of inertia about the neutral axis of the assembly 10, the reinforcement is further provided with laterally projecting flanges 56, which extend longitudinally the entire length of the reinforcement 50, and which are arcuate in the longitudinal direction and parallel to but spaced from the outer wall 22 of the liner plate 20. The outer edges of flanges 56 may be turned downwardly, i.e. outwardly, toward the outer wall 22 of the liner plate, to form flanges 58 which extend longitudinally the entire length of the reinforcement.

The reinforcement 50 may be welded to the liner plate 20 along the end edges of the reinforcement and the abutting end flanges 32, as for example by weldments 60 as shown in FIG. 2. Weldments 60 may be placed in laterally projecting flanges projecting the location of the weldments is not critical. In addition, the outer portion 52 of reinforcement 50 may be plug welded or spot welded at spaced points to the inside surface of outer weld 22. The reinforcement 50 may be attached to the tunnel liner plate 20 by other means, e.g., by bolting, if desired. Addition of end flanges (not shown) to the reinforcement may be desirable in this case, to provide surfaces for bolting the reinforcement to the end flanges 32 of the liner plate 20.

The reinforcement is made of plate metal, typically steel. The thickness of the reinforcement may range from about 14 gauge (0.0747 in. or 0.19 cm) to 8 gauge (0.1644 in. or 0.42 cm) although thinner or thicker plate metal may be used. The thickness of the reinforcement may either equal, exceed or be less than that of the liner plate.

The reinforcement shown results in appreciable increase in moment of inertia and section modulus (both measured about the neutral axis) as compared to a non-reinforced tunnel liner plate of equal thickness. High moment of inertia and high section modulus result in a strong assembly which can withstand a high bending moment imposed by a soil or water load on the outside surface of the liner plate. In other words, an assembly according to the present invention is appreciably stronger than an un-reinforced tunnel liner plate of equal thickness. In order to achieve equal strength in an un-reinforced tunnel liner plate, it would be necessary to use a plate of much thicker gauge and, consequently, much greater weight. In fact, the weight of the equivalent plate having the same strength as the assembly according to this invention is appreciably greater than that of the assembly.

The reinforcement shown has several advantages. First, it imparts much higher moment of inertia/section modulus and strength as noted. Secondly, the U-shaped configuration afforded by the central section 52 and the upstanding side sections or webs 54 on either side leaves all bolt holes in the end flange unobstructed. Third, it does not take away tunnel space since the reinforcement is no deeper (and typically is less deep) than the flanges 28 and 32 The laterally extending flanges 56 afford considerable increase in moment of inertia and section modulus with comparatively little added weight, by virtue of their distance from the neutral axis.

A tunnel liner plate assembly 10 of this invention generally has a moment of inertia, measured either in $inch^4$ or $cm^4$, at least 1.5 times the moment of inertia of an unreinforced plate of the same gauge, and a section modulus, measured in $inch^3$ or $cm^3$, at least twice the section modulus of an unreinforced plate of the same gauge. Moment of inertia is typically increased an average of 100% and section modulus is typically increased an average of 200% with reinforcement according to this invention.

Other reinforcement structures may be used in lieu of the precise shape shown. However, appreciable increase in moment of inertia and section modulus, and non-interference with the end flange bolt holes are required in every reinforcement.

The tunnel liner plate 20 and the reinforcement 50 are formed separately, then assembled and then bent to the desired radius. The tunnel liner plate is blanked from a steel strip. The blank is then formed to pan shape, which is then transferred to a conveyor. (The pan shape as formed is flat in both longitudinal and transverse direction). Meanwhile, the reinforcement may be formed by either conventional break forming or conventional roll forming techniques. In break forming, a reinforcement blank is pressed to the desired shape. In roll forming, the desired shape is rolled and cut to length. At this time the reinforcement is placed inside the pan-shaped tunnel liner plate and attached, e.g. by welding to the tunnel liner. Next, the assembly is transferred to a second form press which simultaneously bends the reinforcement and the tunnel liner plate to the desired radius. From this station, the assembly is transferred to a press which punches the circumferential holes in the tunnel liner plate. Next, the assembly is transferred to a weld station where the two ends of the reinforcement plate are welded to the end flanges of the tunnel liner plate. Finally, the assembled plates are bundled for shipping.

A tunnel liner assembly may be formed inside a tunnel by conventional techniques. This will be described with particular reference to FIGS. 5 and 6. First, a ring of tunnel line plate assemblies, as shown in FIG. 5 is formed by bolting a plurality of tunnel liner plate assemblies 10 together end-to-end along adjacent end flanges. This is customarily done as tunneling progresses, as is known in the art. Additional courses are provided as tunneling progresses by bolting tunnel liner plate assemblies or rings thereof in side-by-side relationship along the side flanges. This gives a lined tunnel as shown in FIG. 6.

This invention will be described further with reference to particular liner plates and reinforcements of the configuration shown in the drawings and described in tis specification, wherein plate thicknesses may range from 12 gauge to $\frac{3}{8}$ inch and reinforcement thicknesses may range from 14 gauge to 8 gauge. TABLES I-A and I-B below show the weight, moment of inertia and section modulus (both measured about the neutral axis), the ratio of moment of inertia to weight and the thickness and weight of an equivalent plate, i.e., a plate which would afford the same strength as an assembly according to this invention, and the weight difference between the weight of an assembly according to this invention and the weight of an equivalent unreinforced plate, for various combinations of plate thickness and reinforcement thickness. TABLE I-A gives the values in English system units (pounds and inches), equivalent metric system units are given in TABLE I-B.

Groupings in TABLES I-A and I-B below are according to plate thickness, expressed in gauge; the last line in each grouping represents an unreinforced liner plate. All dimensions in TABLES I-A and I-B are per plate.

TABLE I-A

| PLATE GAUGE | REINF. GAUGE | WT. LBS. | MOMENT OF INERTIA $IN^4$ | SECTION MODULUS $IN^3$ | MOMENT OF INERTIA PER/LB. | EQUIV. PLATE IN. | WT. LBS. | WT. DIFF/ LBS. |
|---|---|---|---|---|---|---|---|---|
| 12 | 14 | 29.3 | 1.372 | 1.075 | .0468 | 5 ga. | 45 | 15.7 |
| 12 | 12 | 31.9 | 1.524 | 1.245 | .0478 | 5 ga. | 45 | 13.1 |
| 12 | 10 | 34.5 | 1.715 | 1.440 | .0497 | 1/4 | 53 | 18.5 |
| 12 | 8 | 37.0 | 1.859 | 1.588 | .0502 | 1/4 | 53 | 16.0 |
| *12 | — | 22.4 | .735 | .372 | .0328 | — | — | — |
| 10 | 14 | 36.6 | 1.617 | 1.205 | .0442 | 1/4 | 53 | 16.4 |
| 10 | 12 | 39.2 | 1.791 | 1.384 | .0457 | 1/4 | 53 | 13.8 |
| 10 | 10 | 41.8 | 2.004 | 1.621 | .0479 | 5/16 | 65.5 | 23.7 |
| 10 | 8 | 44.3 | 2.165 | 1.745 | .0489 | 5/16 | 65.5 | 21.2 |
| *10 | — | 29.7 | .928 | .473 | .0312 | — | — | — |
| 7 | 14 | 45.9 | 1.960 | 1.381 | .0427 | 5/16 | 65.5 | 19.6 |
| 7 | 12 | 48.5 | 2.162 | 1.572 | .0446 | 5/16 | 65.5 | 17.0 |
| 7 | 10 | 51.1 | 2.401 | 1.784 | .0470 | 3/8 | 79.5 | 28.4 |
| 7 | 8 | 53.6 | 2.585 | 1.950 | .0482 | 3/8+ | 79.5 | 25.9 |
| *7 | — | 39.0 | 1.207 | 0.621 | .0309 | — | — | — |
| 5 | 14 | 51.9 | 2.176 | 1.489 | .0419 | 5/16 | 65.5 | 13.6 |
| 5 | 12 | 54.5 | 2.396 | 1.686 | .0440 | 3/8 | 79.5 | 25.0 |
| 5 | 10 | 57.1 | 2.650 | 1.902 | .0464 | | | |
| 5 | 8 | 59.6 | 2.853 | 2.077 | .0479 | | | |
| *5 | — | 45.0 | 1.385 | .718 | .0308 | — | — | — |

*For plate without reinforcement
All dimensions are per plate

TABLE I-B

| PLATE GAUGE | REINF. GAUGE | WT. KB. | MOMENT OF INERTIA $CM^4$ | SECTION MODULUS $CM^3$ | MOMENT OF INERTIA PER/KB. $CM^4/KG.$ | EQUIV. PLATE CM. | WT. KG. | WT. DIFF/ KG. |
|---|---|---|---|---|---|---|---|---|
| 12 | 14 | 13.3 | 57.107 | 17,616 | 4.295 | 5 ga. | 20.4 | 7.1 |
| 12 | 12 | 14.5 | 63.433 | 20.402 | 4.387 | 5 ga. | 20.4 | 5.9 |
| 12 | 10 | 15.6 | 71.383 | 23.597 | 4.561 | 0.64 | 24.0 | 8.4 |
| 12 | 8 | 16.8 | 77.377 | 26.022 | 4.605 | 0.64 | 24.0 | 7.2 |
| *12 | — | 10.2 | 30.593 | 6.096 | 3.009 | — | — | — |
| 10 | 14 | 16.6 | 67.304 | 19.746 | 4.056 | 0.64 | 24.0 | 7.4 |
| 10 | 12 | 17.8 | 74.547 | 22.680 | 4.193 | 0.64 | 24.0 | 6.2 |
| 10 | 10 | 19.0 | 83.412 | 26.563 | 4.396 | 0.79 | 29.7 | 10.7 |
| 10 | 8 | 20.8 | 90.114 | 28.595 | 4.486 | 0.79 | 29.7 | 9.6 |
| *10 | — | 13.5 | 38.626 | 7.751 | 2.864 | — | — | — |
| 7 | 14 | 20.8 | 81.581 | 22.630 | 3.918 | 0.79 | 29.7 | 8.9 |
| 7 | 12 | 22.0 | 89.989 | 25.760 | 4.092 | 0.79 | 29.7 | 7.7 |
| 7 | 10 | 23.2 | 99.937 | 29.234 | 4.312 | 0.95 | 36.1 | 12.9 |
| 7 | 8 | 24.3 | 107.595 | 31.955 | 4.422 | 0.95+ | 36.1 | 11.8 |
| *7 | — | 17.7 | 50.239 | 10.176 | 2.835 | — | — | — |
| 5 | 14 | 23.5 | 90.572 | 24.400 | 3.845 | 0.79 | 29.7 | 6.2 |
| 5 | 12 | 24.7 | 99.729 | 27.628 | 4.037 | 0.95 | 36.1 | 11.4 |
| 5 | 10 | 25.9 | 110.301 | 31.168 | 4.257 | | | |
| 5 | 8 | 27.0 | 118.750 | 34.036 | 4.396 | | | |
| *5 | — | 20.4 | 57.648 | 11.766 | 2.826 | — | — | — |

*For plate without reinforcement
All dimensions are per plate
Referring to TABLE I-A and I-B and taking the data line for 12 gauge plate and a 10 gauge reinforcement for purpose of illustration, the assembly so resulting has a weight of 34.5 pounds (15.6 kg), compared to a weight of 22.4 pounds (10.2 kg) for the liner plate alone. However, the moment of inertia of the assembly and the section modulus of the assembly are 1.715 inch to $^4$ and 1.440 inch to 3, respectively, compared to 0.735 inch $^4$ and 0.372 inch $^3$, respectively, for the liner plate alone. The next column shows that the assembly has a moment of inertia/weight ratio of 0.0497 inch to $^4$/lb. compared to 0.0328 inch $^4$/lb. for the tunnel liner plate alone, showing that the assembly has a much more favorable I/wt. ratio, indicating much improved strength with relatively little increase in weight. Finally, an equivalent tunnel liner plate having the same strength would have a thickness of ¼ inch (0.640 cm) and a weight of 53 pounds (24 kg) representing a weight difference of 18.5 pounds (8.4 kg). Data in TABLES I-A and I-B show that the most remarkable improvements, as shown by weight differential between an assembly of the present invention and an equivalent plate, are obtained when a 10 gauge reinforcement is used. TABLES I-A and I-B also shows that a 5 gauge tunnel liner plate reinforced with a 10 gauge reinforcement is stronger than a ⅝ inch thick tunnel liner plate; ⅝ inch represents about the maximum thickness that one would ordinarily use in making a tunnel liner plate.

The moment of inertia of the assembly according to this invention was determined as follows: the reinforcement 50 was divided into 13 elements, the moment of inertia for each element was calculated and these moments of inertia were summed to obtain the moment of inertia of the entire reinforcement. This moment of inertia in combination with the established moment of inertia of the tunnel liner plate was summed in order to determine the moment of inertia for the assembly. The formulas given below were used in the calculation. While these formulas are standard mechanical engineering formulas which are well known in the art, they are given below for convenience.

$$I = y^2\,dA$$

$$I_S = I + Ad^2$$

$$S = I/c$$

I = Moment of Inertia with respect to the Neutral Axis
dA = Differential Area parallel to the Neutral Axis
Y = Distance from the Neutral Axis to the Differential Area
$I_S$ = The Moment of Inertia of a Section that is the result of its components
A = Cross-Sectional area of component
d = Distance between Centroidal and Parallel Axis
S = Section Modulus
c = The Distance from the Neutral Axis to the Outermost Fiber While this invention has been described in detail with respect to the best mode and preferred embodiment thereof, it shall be understood that this description is by way of illustration and not by way of limitation.

What is claimed is:

1. A tunnel liner plate assembly comprising:

(a) a tunnel liner plate of generally rectangular configuration and having a longitudinal direction and a transverse direction, said liner plate comprising a longitudinally curved and transversely essentially uncurved wall having opposed inside and outside surfaces, inwardly extending side flanges and inwardly extending end flanges, each of said flanges having a plurality of bolt holes, said wall having a pair of spaced longitudinally extending reinforcing ribs and a longitudinally curved web therebetween;

(b) a stiff longitudinally extending reinforcement comprising a longitudinally curved center portion having essentially the same longitudinal curvature as said tunnel liner plate and which abuts the inside surface of the web of the wall of said liner plate, a pair of upstanding longitudinally extending side portions which are integrally joined to said center portion along longitudinally extending edges and extend inwardly from said inside surface of said web of said wall, and laterally projecting members which are integral with respective side portions and disposed laterally outwardly therefrom, and which are spaced from said wall of said liner plate, said reinforcements having end edges which abut the respective end flanges of said liner plate and are attached thereto, the configuration of the center portion and the upstanding side portions of said reinforcement being such as not to interfere with any of the bolt holes of the end flanges, said reinforcement being fixedly secured to said liner plate.

2. A tunnel liner plate assembly according to claim 1 in which said laterally projecting members project laterally outwardly from the inward edges of said upstanding side members and in which said laterally projecting members extend the entire length of said reinforcement.

3. A tunnel liner plate assembly according to claim 1 in which said reinforcement is welded to the end flange of said tunnel liner plate.

4. A tunnel liner plate assembly according to claim 1 in which said tunnel liner plate and said reinforcement are each formed of plate steel, said tunnel liner plate having a thickness from about 0.10 inch to about 0.4 inch and said reinforcement having a thickness from about 0.05 inch to about 0.2 inch.

5. A tunnel liner plate assembly according to claim 1 in which the end flanges of a liner plate each have an odd number of bolt holes.

6. A tunnel liner plate assembly according to claim 1 in which the depth of said reinforcement, measured perpendicular to the wall of said tunnel liner plate, is less than the depth of said flanges.

7. A tunnel liner plate assembly according to claim 1 in which the moment of inertia, measured in $inch^4$ or $cm^4$ is at least about 1.5 times the moment of inertia of an unreinforced plate of the same gauge, and in which section modulus, measured in $inch^3$ or $cm^3$, is at least about twice the section modulus of an unreinforced plate of the same gauge.

8. A tunnel liner plate assembly according to claim 1 in which said reinforcement is a one-piece member.

9. A tunnel liner plate assembly according to claim 8 in which the center portion and the upstanding side portions of said reinforcement together form a channel of generally U-shaped cross section.

* * * * *